US006209151B1

(12) United States Patent
Schwimmer

(10) Patent No.: US 6,209,151 B1
(45) Date of Patent: Apr. 3, 2001

(54) UNIVERSAL DUAL BEADED POOL LINER

(75) Inventor: Larry Schwimmer, New York, NY (US)

(73) Assignee: International Leisure Products, Inc., Edgewood, NY (US)

( * ) Notice: Subject to any disclaimer, the term of this patent is extended or adjusted under 35 U.S.C. 154(b) by 0 days.

(21) Appl. No.: 09/506,461

(22) Filed: Feb. 17, 2000

Related U.S. Application Data

(60) Provisional application No. 60/166,185, filed on Nov. 18, 1999.

(51) Int. Cl.[7] ..... E04H 4/00
(52) U.S. Cl. ..... 4/506
(58) Field of Search ..... 4/506, 513, 496, 4/503, 498

(56) References Cited

U.S. PATENT DOCUMENTS 4,429,425 * 2/1984 Weir et al. ..... 4/503
5,155,872 * 10/1992 Aymes ..... 4/506
5,720,056 * 2/1998 Aymes ..... 4/448

* cited by examiner

*Primary Examiner*—Henry J. Recla
*Assistant Examiner*—Huyen Le
(74) *Attorney, Agent, or Firm*—Herold and Haines, P.A.; Brian L. Wamsley, Esq.

(57) ABSTRACT

A liner for swimming pools and, more particularly, a flexible plastic liner for above-ground swimming pools that is attached to the upper edge of the swimming pool wall. The pool liner of this invention has a plastic "beading" around its circumference, or border, which has a removable J-hook portion in connection with a bead portion. This beading arrangement allows the liner to be attached to pool walls that have "bead receivers" for attachment of beaded liners and to pool walls that have no bead receivers. The beading has perforations provided therein to facilitate the removal of the J-hook portion from the bead portion to convert the beading from a J-hook type liner to a bead type liner for insertion into a bead receiver.

12 Claims, 3 Drawing Sheets

UNIVERSAL DUAL BEADED POOL LINER

This application is based on provisional patent application 60/166185 filed under 37 C.F.R. § 1.53(b)(2) on Nov. 18, 1999. The disclosure and information contained therein is incorporated here by reference.

BACKGROUND OF THE INVENTION

The present invention relates to a liner for swimming pools and, more particularly, a flexible plastic liner for above-ground swimming pools that is attached to the upper edge of the swimming pool wall. The pool liner of this invention has a plastic "beading" around its circumference, or border, which has a removable J-hook portion in connection with a bead portion. This beading arrangement allows the liner to be attached to pool walls that have "bead receivers" for attachment of beaded liners and to pool walls that have no bead receivers. The beading has perforations provided therein to facilitate the removal of the J-hook portion from the bead portion to convert the beading from a J-hook type liner to a bead type liner for insertion into a bead receiver.

Above-ground swimming pools are designed to use flexible plastic liners to provide a water-tight compartment to hold the water. Generally, pool liners used in above-ground pools are simply "overlapped" onto the upper edge of the pool wall. Once overlapped, the liner edge is held in place by a series of clips placed over the liner and pool edge at intervals around the pool wall. Roughly 80% of above-ground pools sold are designed to use these overlap liners. Liners with "J-hooks" can also be used in pools designed for overlap liners. See FIG. 1. The J-hook, in actuality an inverted "U," is an improvement in the overlap liner. It comprises extruded plastic hook type beading around the edge of the liner so that the liner hangs on the edge of the pool wall.

As is often the case, plastic pool liners develop holes and tears that require removal and replacement of the liner from time to time. The problem with overlap liners and J-hook liners is that decks are usually built around the pool after the liner is installed, at the height of the upper edge of the pool wall. Thus, the pools must be disassembled to replace the liner. To overcome this inconvenience and allow for easier replacement of the liner, some above-ground pools are equipped with a device for receiving a plastic bead formed around the circumference of the liner. Accordingly, the "bead" of the liner is inserted into the bead receiver installed on the upper edge of the pool wall. See FIG. 2. Also known as a "hung liner," a beaded liner is removable but cannot also be used as an overlap liner because the liner itself is too short in order to fit the bead receiver.

The situation created with the above prior art is such that a supplier of pool liners must keep three different types of liners in stock for each size of above-ground pool, resulting in great inconvenience and inventory expense to the supplier. Further, a manufacturer of pool liners must manufacture all three types of liners to meet market needs. It is therefore desirable that all three types of application of pool liners be met by a single pool liner design.

It is therefore an object of the present invention to provide a pool liner having the versatility of being applicable to an above-ground swimming pool in the manner of an overlap or J-hook liner, or in the manner of a hung or beaded liner.

It is also an object of this invention to provide a pool liner that can be easily removed and replaced.

SUMMARY OF THE INVENTION

The present invention relates to a dual beaded pool liner having plastic extrusion beading provided around its circumference that is convertible from a J-hook liner to a beaded liner.

The versatility of the dual beaded liner allows the liner to be installed in a pool in the manner of an overlap liner, J-hook liner or as a beaded liner in a pool having a bead receiver.

In accordance with the present invention, a plastic extrusion beading is provided along the edge of a flexible pool liner installable in an above-ground swimming pool. The end of the beading is configured in the form of an inverted hook which, together with the body of the beading, forms the shape of a "J" in the manner of J-hook pool liners. Perforations are provided in the body of the beading opposite to and corresponding with the end of the "J-hook" portion. The perforations permit the J-hook portion of the beading to be removable, at the option of the pool owner. Other means may also be employed to permit the easy removal of the J-hook portion, such as an embedded pull cord, scoring or similar device. A bead is formed in the body of the beading adjacent to and immediately below the perforations or scoring. When the J-hook portion is removed, the bead portion becomes the end of the beading such that it may be installed into a bead receiver. Once removed from the beading, the disassociated J-hook portion more closely resembles an inverted "U" as the tail portion of the "J" is the remaining body of the beading.

BRIEF DESCRIPTION OF THE DRAWINGS

The above objects and advantages of the invention will become manifest to one skilled in the art from considering the following detailed description of an embodiment of the invention in light of the accompanying drawings, in which.

DETAILED DESCRIPTION OF THE INVENTION

Figure 1:
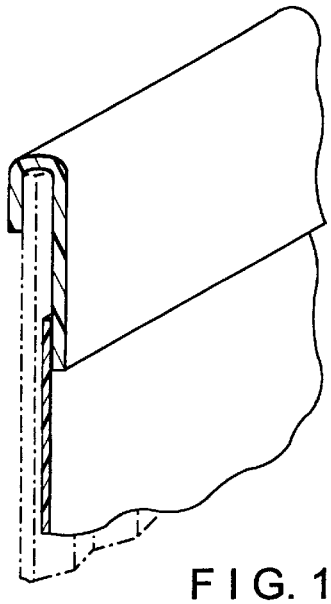
F I G. 1 PRIOR ART
FIG. 1 is a sectional view of a J-hook overlap liner of the prior art.
Figure 2:
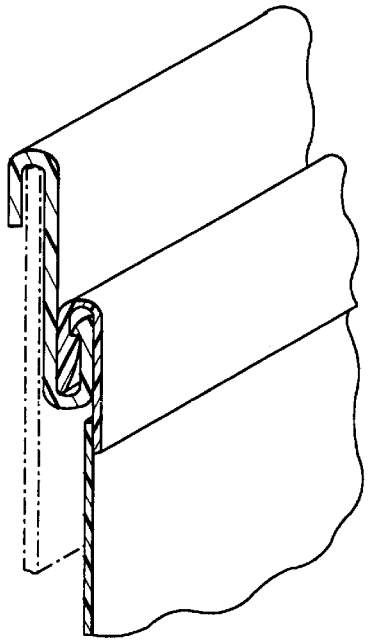
F I G. 2 PRIOR ART
FIG. 2 is a sectional view of a beaded liner of the prior art, installed in a bead receiver.

Turning now to the drawings, there is illustrated in FIG. 1 a segment view of a pool liner having J-hook beading as known in the prior art. The J-hook beading is bonded to the flexible pool liner by heat annealment, plastic cement or similar bonding mechanism. The J-hook part of the bead is shown as installed on the upper edge of the pool wall. In this type of improved overlap liner, no clips are necessary. Similarly, FIG. 2 illustrates the further prior art of a bead type pool liner. As shown, the bead of the liner is installed into a track of a special bead receiver. The bead receiver is attached to the upper edge of the pool wall in the same manner as the J-hook liner. Bead receivers are generally furnished by the pool manufacturer and come with the pool.

Figure 3:
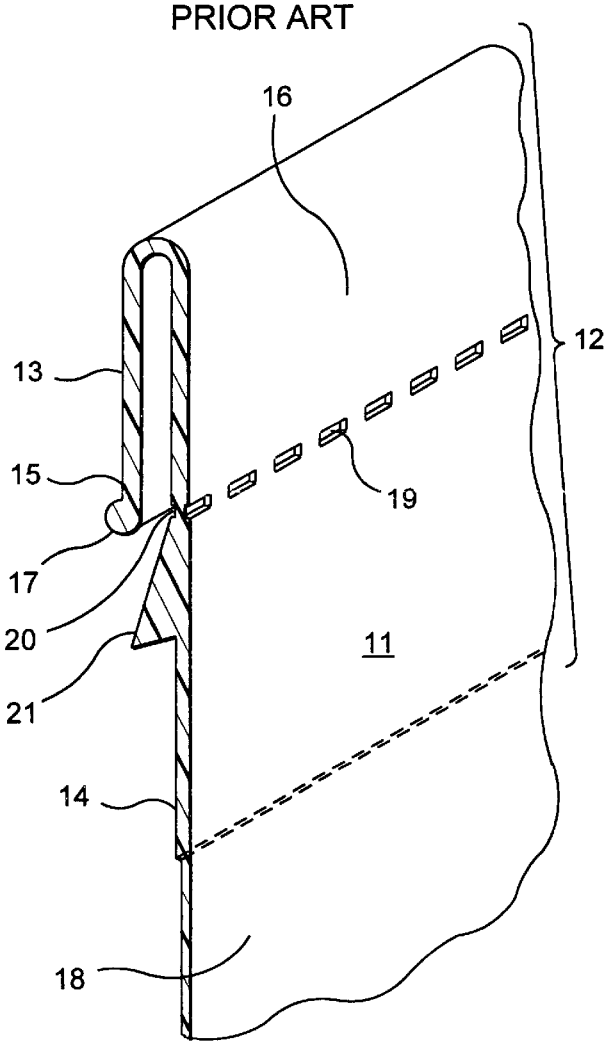
FIG. 3 is a sectional view of the dual beaded liner of the present invention.

There is illustrated in FIG. 3 a segment of the universal dual beaded pool liner 11 of the within invention. The beading 12 is comprised of a J-hook portion 13 and a bead portion 14. The J-hook portion 13 is provided at the outer edge of the beading 12, and is configured as an inverted "U" to be slipped over the upper edge of the swimming pool (not shown), in the manner of the prior art J-hook liner. See FIG. 1. The J-hook has a terminal end 15 for placement over the upper edge of the swimming pool wall, and a base end 16. The terminal end 15 may be constructed to have a beaded or reinforced edge 17 to provide additional strength or for ease of placement of the J-hook 13 over the pool edge. The base end 16 of the J-hook 13 is located adjacent the bead portion 14 and is defined from the bead portion 14 by a series of perforations 19 or other similar means for detaching the J-hook portion 13 from the bead portion 14.

The beading 12 itself is constructed as a single unit of a strong but flexible material, such as extruded plastic or the like. Examples of such flexible plastic materials are nylon, polypropylene, polyethylene or PVC, although a person of ordinary skill in the art can select other suitable flexible plastic materials. As in the prior art, the beading 12 is attached to the flexible pool liner 18 by heat annealment, plastic cement or similar bonding mechanisms known in the art. At the base end 16 of the J-hook portion 13 of the beading 12 a series of perforations 19 is provided to facilitate the separation of the J-hook 13 portion from the bead portion 14. Other means known in the art may be employed in place of the perforations 19 to accomplish the desired result, such as a pull cord 20 made of wire, string or plastic, or the beading 12 could be scored in place of the perforations 19.

Figure 4:
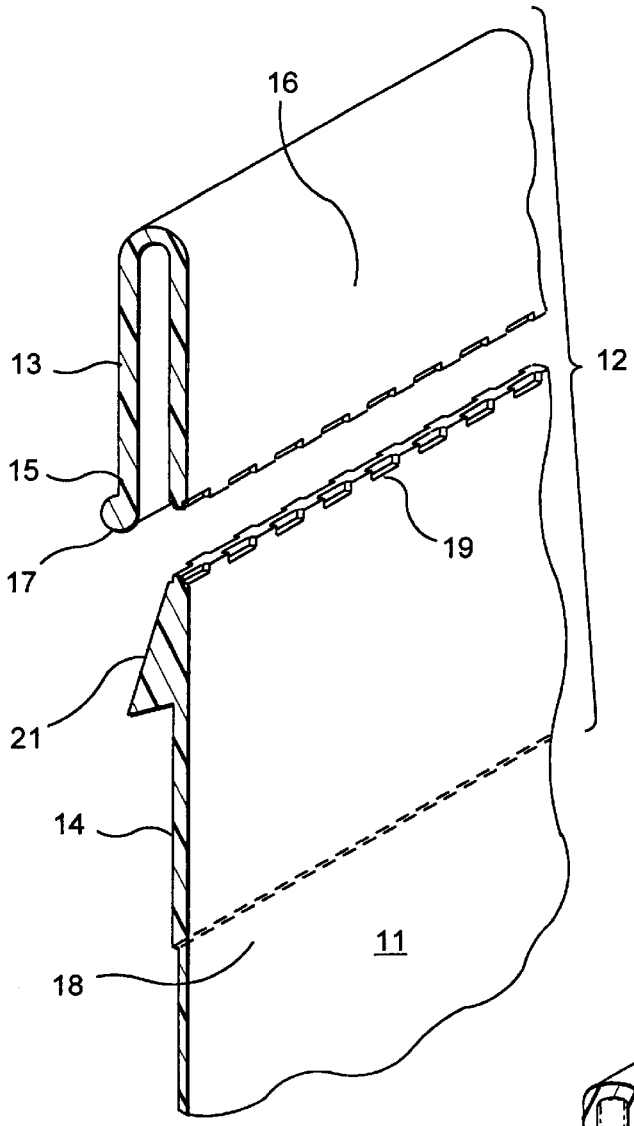
FIG. 4 is a further sectional view of the present invention with the J-hook portion removed.
Figure 5:
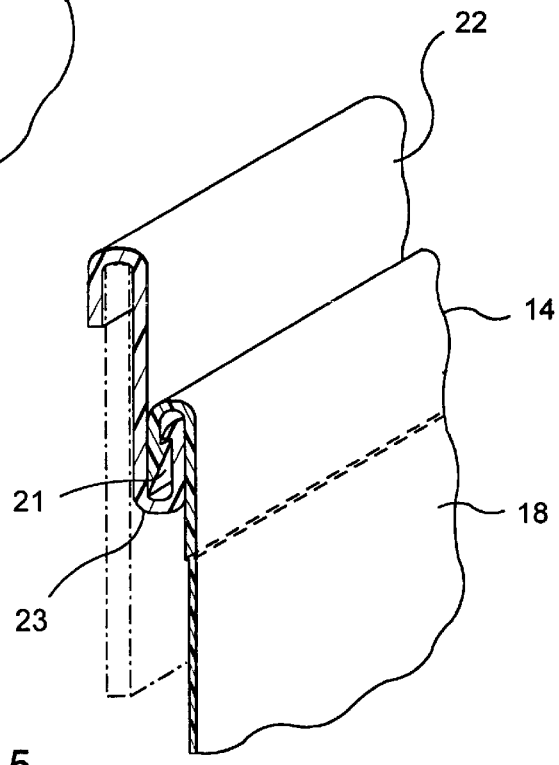
FIG. 5 is a sectional view of the present invention with the bead portion of the liner installed in a bead receiver.

A standard type bead 21 insertable into a track of a bead receiver is provided adjacent the but below the perforations 19 in the body of the beading 12, which is permanently attached to the flexible portion of the liner 18. The bead portion 14 of the beading 12 becomes usable after the J-hook portion 13 has been removed. Removal of the J-hook portion 13 exposes the bead portion 14 (see FIG. 4) so that the bead 12 may be removably installed into the track 23 of a bead receiver 22 provided with the swimming pool. FIG. 5.

According to the above description, the dual beaded pool liner 11 of the present invention may be installed in an above-ground swimming pool in the manner of an overlap or J-hook liner without alteration of the beading. Alternatively, the dual beaded liner 11 may be converted to a bead type liner by removal of the J-hook portion 13 by tearing the beading 12 along the perforations 19, or by pulling an embedded cord 20 or other similar means.

Figure 6:
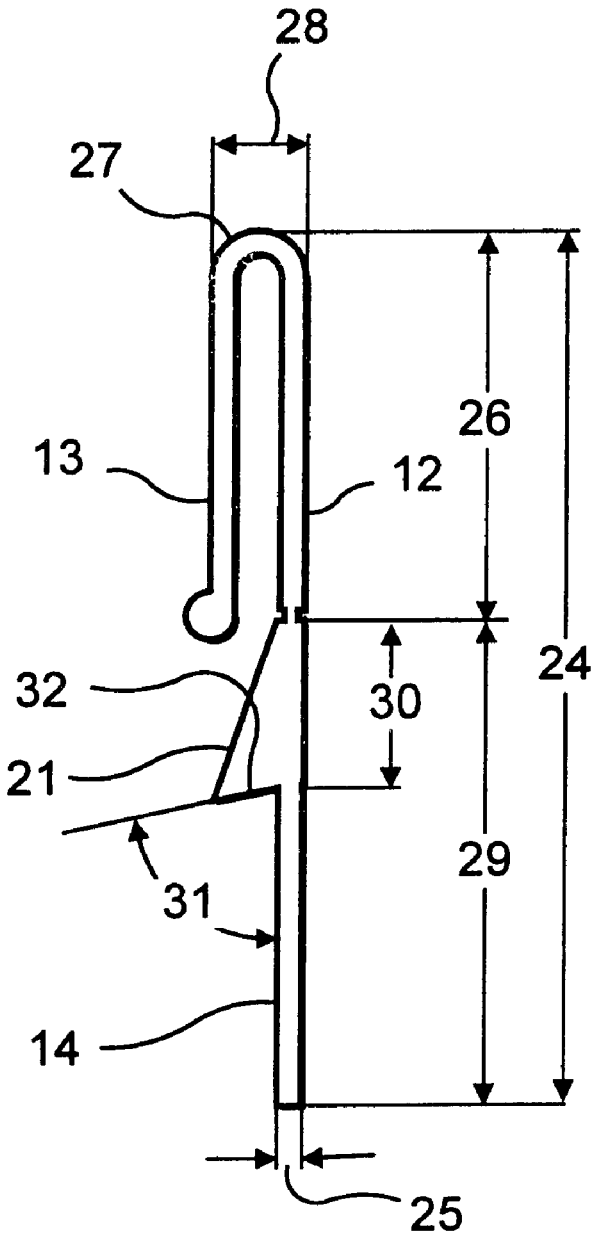
FIG. 6 is a dimensional view of the present invention.

FIG. 5 illustrates the use of the within invention as a bead liner, and FIG. 6 illustrates the manufacturing dimensions of the present invention. Although the dual beaded pool liner of the present invention may be of almost any size or dimension to meet the needs of a particular application, pool wall thicknesses are of such general uniformity that great variation in dimensions is not needed. Referring then to FIG. 6, the manufacturing dimensions of a preferred embodiment of the present invention are given. Generally, the beading 12 has an overall length of about 1.8 inches, preferably 1.8465 inches, and a thickness generally of about 0.05 to 0.8 inches 25. The J-hook portion 13 is about from 0.8 to 0.9 inches long, preferably 0.83 inches. The bend 27 in the J-hook 13 has a radius of about 0.1 inches, preferably 0.097 inches, for an overall "thickness" of the J-hook to be about 0.2 inches, preferably 0.194 inches. The bead portion 14 has an overall length of about 1.025 inches 29, of which the bead 21 itself is from about 0.3 to 0.4 inches, preferably 0.35 inches in length 30. Bead 21 is configured to have a beveled edge 32 so that the bead 21 can be snapped into the track 23 of a bead receiver 22 and be held securely.

While the present invention has been explained in relation to its preferred embodiment, it is to be understood that various modifications thereof will be apparent to those skilled in the art upon reading this specification. The invention disclosed herein is therefore intended to cover all such modifications that fall within the scope of the appended claims.

What is claimed is:

1. A universal liner for above-ground swimming pools, comprising;

a flexible pool liner portion, a beading portion permanently bonded to the periphery of the pool liner portion, said beading portion comprising;

a hook portion provided on an outer edge of said beading portion, said hook portion being configured for placement over the upper edge of an above-ground swimming pool;

a bead portion adjacent said hook portion, said bead portion being configured for removable attachment to a bead receiver of an above-ground swimming pool;

wherein said hook portion is detachable from said bead portion.

2. The universal pool liner of claim 1, further comprising detachment means to facilitate detachment of the hook portion from the bead portion.

3. The universal pool liner of claim 2, wherein the detachment means is a series of perforations positioned between the hook portion and the bead portion.

4. The universal pool liner of claim 2, wherein the detachment means is an embedded cord or wire positioned between the hook portion and the bead portion.

5. The universal pool liner of claim 1, wherein said bead portion further comprises a bead and said bead is configured such that it is removably insertable into a bead receiver of an above-ground swimming pool.

6. The universal pool liner of claim 1, wherein the removal of the hook portion exposes the bead portion and thus enabling the bead portion to become removably instable into a bead receiver of an above-ground swimming pool.

7. The universal pool liner of claim 1, wherein the beading portion is manufactured from an extrudable plastic material.

8. A universal liner for above-ground swimming pools, comprising;

a swimming pool liner having a peripheral edge;

a beading portion located at said peripheral edge of said liner, said beading portion comprising;

a hook portion provided at an end of said beading portion, said hook portion being configured as a "J" for enabling placement of the beading portion on an upper edge of an above-ground swimming pool;

a bead portion located between said hook portion and the peripheral edge of the pool liner;

separation means between hook portion and said bed portion;

wherein said hook portion is detachable form said bead portion by use of said separation means.

9. The universal pool liner of claim 8, wherein said separation means comprises a series of perforations or embedded cord or wire, located between said hook portion and said bead portion.

10. The universal pool liner of claim 8, wherein said hook portion further comprises a reinforced edge at an outer edge of said hook portion.

11. The universal pool liner of claim 8, wherein said bead portion further comprises a bead and said bead is configured such that it is removably insertable into a bead receiver of an above-ground swimming pool.

12. The universal pool liner of claim 8, wherein the removal of the hook portion exposes the bead portion and thus enabling the bead portion to become removably insertable into a bead receiver of an above-ground swimming pool.

* * * * *